US006381910B1

(12) United States Patent
Katz

(10) Patent No.: US 6,381,910 B1
(45) Date of Patent: May 7, 2002

(54) ENTRYWAY PROTECTOR

(76) Inventor: Edward R. Katz, 20 W. Ridge Ct., SE., Cartersville, GA (US) 30121-8106

( * ) Notice: Subject to any disclaimer, the term of this patent is extended or adjusted under 35 U.S.C. 154(b) by 0 days.

(21) Appl. No.: 09/695,885

(22) Filed: Oct. 25, 2000

Related U.S. Application Data

(63) Continuation-in-part of application No. 09/580,097, filed on May 30, 2000, which is a continuation of application No. 09/223,985, filed on Dec. 31, 1998, now Pat. No. 6,128,862.

(51) Int. Cl.[7] ..... E04B 1/344

(52) U.S. Cl. ..... 52/211; 52/741.3; 52/2.12; 49/460

(58) Field of Search ..... 52/211, 2.11, 741.3; 410/119; 49/460, 70

(56) References Cited

U.S. PATENT DOCUMENTS 1,126,243 A * 1/1915 McQuown
1,719,364 A * 7/1929 Gilkey
3,808,981 A * 5/1974 Shaw ..... 105/369 BA
4,372,364 A * 2/1983 Katz ..... 150/52 R
4,691,955 A * 9/1987 Pousar ..... 294/142
6,128,862 A * 10/2000 Katz ..... 52/2.11
6,216,396 B1 * 4/2001 Katz ..... 52/2.11

* cited by examiner

*Primary Examiner*—Carl D. Friedman
*Assistant Examiner*—Basil Katcheves
(74) *Attorney, Agent, or Firm*—Harold L. Marquis

(57) ABSTRACT

The present invention is a protection device for use with elevator door jamb panels and entryway doors and jambs to protect the surfaces of these panels and doors from sustaining damage from collisions with moving equipment, building materials and furniture. The device protects the surfaces from scratches and dents when furniture and construction materials inadvertently bang into these protected surfaces. The entryway protector includes two sections and a securing system. A main rectangular section is separated by a line of stitching from a minor rectangular section, both sections including a padding material. The securing system can secure the protector to the surfaces against dislodging by contact with equipment, building materials and furniture.

6 Claims, 5 Drawing Sheets

ENTRYWAY PROTECTOR

This is a continuation-in-part application of pending U.S. patent application Ser. No. 09/580,097, filed May 30, 2000, which is a continuation of Ser. No. 09/223,985 filed Dec. 31, 1998, U.S. Pat. No. 6,128,862.

BACKGROUND OF THE INVENTION

1. Field of the Invention

The present invention relates to a protective device for protecting exposed entryways and doors from the inadvertent contact and possible damage by furniture, equipment, construction materials and the like being moved.

2. Description of Related Art

The relocation industry employs numerous devices and methods in order to provide the quickest, safest and most inexpensive move possible for their clients. Moving companies and related industries constantly develop, test and refine innovative products so that such a move is possible. For example, moving companies often utilize lifting devices that are easily movable through constricted spaces, such as door frames. These lifting devices can safely secure a heavy load and allow just a single person to navigate the load in and out of buildings. These devices also reduce the risk of injury to movers.

A typical office mover employs several individuals to load and unload furniture on and off of moving equipment or move the furniture by hand. The moving equipment typically is pushed or pulled through the office, through the office doors, into an elevator, out of the elevator, and through the building's front doors. This procedure is repeated, in reverse, to move the furniture into the new office space. Throughout this moving process, edges and corners of, for example, a hand truck or the furniture can inadvertently come in contact with walls, doors and jambs, not only damaging the moving equipment and furniture, but also the walls, doors and jamb surfaces.

Similar to the moving process described above, customized construction in an office space can pose a similar risk to both the moving equipment and building materials, and the surfaces of the building's walls, doors and jambs. The expense of repairing damaged walls, doors and door jambs typically falls upon the building owner, the landlord or building management. Thus, movers and contractors rarely bring to the site protective pads to place between the moving loads and the exposed surfaces. Even so, movers and contractors want to minimize such damage to buildings to maintain a quality reputation. Thus, movers and contractors utilize moving equipment designed to avoid this type of damage.

One such product is the Spider Crane® used by Office Moving Systems of Atlanta, Ga. The Spider Crane® lifts full lateral files high enough to roll a specially designed steel dolly underneath the files. While the cabinet is held safely suspended, a member of the moving crew slides the steel dolly underneath the cabinet which is then gently lowered. This type of device not only reduces injuries, but also enables the client to minimize down time since the Spider Crane® lifts a full file cabinet. Thus, the client need not unload the cabinets and pack the files in boxes. The proper use of this type of device also reduces the expense to the moving company of patching and painting walls damaged by moving the cabinets through the office versus when cabinets are moved in more traditional ways, such as by a two-wheel dolly or hand truck, where there is less control over the cabinets while they are moved in and out of buildings.

Even with the best of care, there is always the risk of damage to property during the moving process. Damage is not confined to the items and products being moved, but can also be sustained by the office or residential structure itself which can be banged, dinged or scratched by the items or the moving equipment such as dollies and hand trucks. The transportation of construction materials through a building passageway also can cause damage, specifically damaging areas of narrowing in the passageway, which are typically at doorways and elevators. An inadvertent scrape can damage the paint, wallpaper and other building surface material.

Superior barrier-type protection devices are disclosed in U.S. patent application Ser. Nos. 09/223,985 and 09/580,097, which applications are fully incorporated herein by reference. These protection devices include an inflatable main section, a padded minor flap and securing components. The padded minor flap is foldably connected to the main section along the lengths of the flap and main section, that is, a vertical fold line enables the flap and main section to fold toward or away one another like pages of a book.

With the manufacture and use of these devices, it was noted that certain modifications of the principal design could be improved upon, for example, that the main section could include cushioning material rather than an inflatable mechanism, that the device also could be foldable about horizontal fold lines, not just vertical fold lines, that the minor flap could itself be vertically foldable, and that the minor flap could extend in length beyond the main section. Therefore it can be seen that there is a need in the art for a lightweight, easily constructed, inexpensive, noninvasive and portable barrier-type device that can protect building surfaces.

BRIEF SUMMARY OF THE INVENTION

Briefly described, in its preferred form, the present invention comprises a barrier device for use with elevator door jamb panels and entryway doors and jambs to protect the surfaces of these panels and doors from sustaining damage from collisions with moving equipment, building materials and furniture. The present invention is a protection device placed against the at-risk wall or door surface. The device protects the surfaces from scratches and dents when furniture and construction materials inadvertently bang into these protected surfaces.

The present entryway protector is a barrier-type device that a landlord or property manager can quickly and easily install both to protect the elevator jamb panels and the sidewalls of the adjacent elevator hallway, and to protect open doors from scratches and dents. The invention preferably comprises two sections and a securing component. A main rectangular section is separated by a vertical line of stitching from a smaller section, or minor rectangular flap. The minor flap can be further provided with a vertical line of stitching forming two minor flap components. Both the main section and minor flap are also provided with at least one horizontal line of stitching. The vertical and horizontal lines of stitching provide fold lines for the device.

The main section and minor flap preferably comprise a cushioning material enclosed within a protective sleeve of thick vinyl. The securing component is capable of releasably securing the protection device to the at-risk surface.

In applications where the present invention is placed at the entrance of an elevator, the entryway protector is placed so that the minor flap folds along a perpendicular edge of the main section. The minor flap is placed in contact with, and is hung against, the jamb panel in proximity to the elevator door using the securing component. Preferably, the minor flap is hung on the jamb panel using suction cups. The jamb panels in proximity to the elevator door typically have one of two possible widths, approximately seven or 14 inches. The minor flap is designed such that the two minor flap components can be folded upon each other, to provide seven inches of protection, or need not be folded atop one another, wherein the combined width of the two minor flap components side-by-side is 14 inches.

The vertical line of stitching between the main section and the minor flap is preferably aligned with the corner edge of the door jamb panel and the hallway wall in which the elevator is set. The main section extends along a portion of the length of the hallway wall from the corner edge, away from the elevator. In this configuration, both the jamb panel of the elevator and a length of the hallway wall are protected from contact with moving equipment, construction materials and furniture.

In another application, the protector can "hug" an open door, so the door can remain open while protected from construction materials or furniture moving in and out of the entrance. In this embodiment, the securing component can comprise loop and hook fasteners combined with straps extending from the main section to secure the protector around the door. In this manner, the door is hugged and secured snug by the protector. The protector is held in place by inserting the straps through the spaces between the hinges of the door, which are then secured to the minor flap.

The main section of the present invention is capable of remaining upright without any wall attachment because the main section has both a sufficiently thick bottom edge surface to support it in the upright position, and rigidity from the cushioning material enclosed within the protective sleeve of thick vinyl. It has been found that if the main section comprises a cushioning pad of approximately three inch thickness, the main section will sufficiently remain upright against the surface. The minor flap preferably comprises a cushioning pad of approximately one inch thickness. When the minor flap of the present invention is hung against the elevator jamb panel by the securing component, both panels remain upright, and thus stay in place even when contacted by furniture or equipment.

Other features of the present invention include its economical cost, its ease of carrying as it can be folded about both the vertical and horizontal lines of stitching, and the ease in which the device fits snug around a door and is supported near an elevator. Further, unlike furniture pads, the present invention remains in the upright position so the protection device does not crumple to the floor. In order to use furniture pads to protect the hallway walls, hanging attachments must be secured into the wall, which attachments necessarily damage the wall. Conversely, the present invention is noninvasive.

Thus, it is an object of the present invention to provide a lightweight, portable and inexpensive protection device to protect wall and door surfaces from collision with furniture, moving equipment and construction materials.

It is another object of the present invention to provide a protection device that can be easily moved and placed in position by one individual.

It is a further object of the present invention to provide a protection device comprising a padded main section with a minor flap.

These and other objects, features and advantages of the present invention will become more apparent upon reading the following specification in conjunction with the accompanying drawing figures.

DETAILED DESCRIPTION OF A PREFERRED EMBODIMENT

Figure 1:
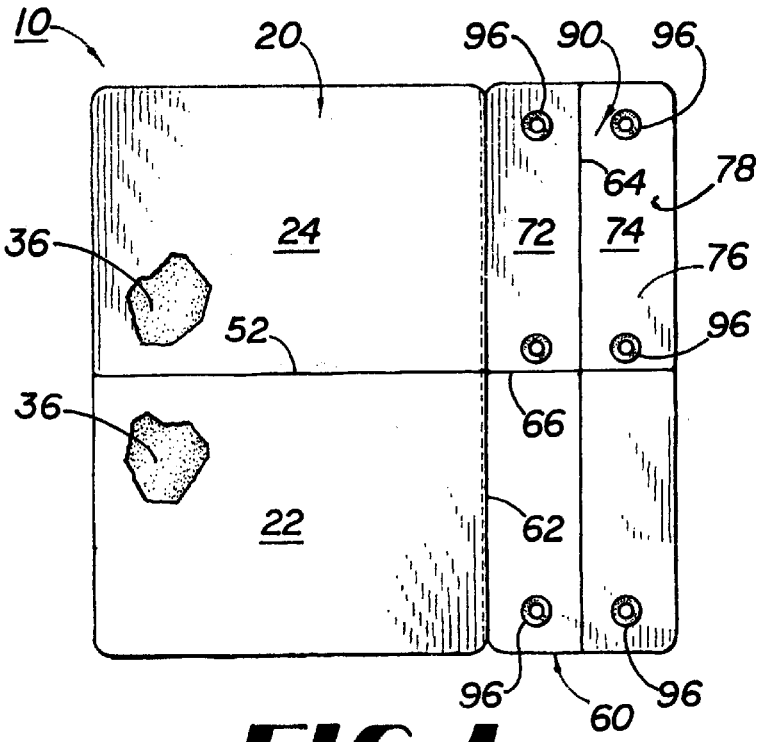
FIG. 1 is a front view of an entryway protection device according to a preferred embodiment of the present invention.

Referring now in detail to the drawing figures, wherein like reference numerals represent like parts throughout the several views, FIG. 1 shows a front view of a preferred embodiment of the present entryway protector 10. Preferably, the entryway protector 10 comprises a main section 20, a minor flap 60 and a securing component 90.

Figure 2:
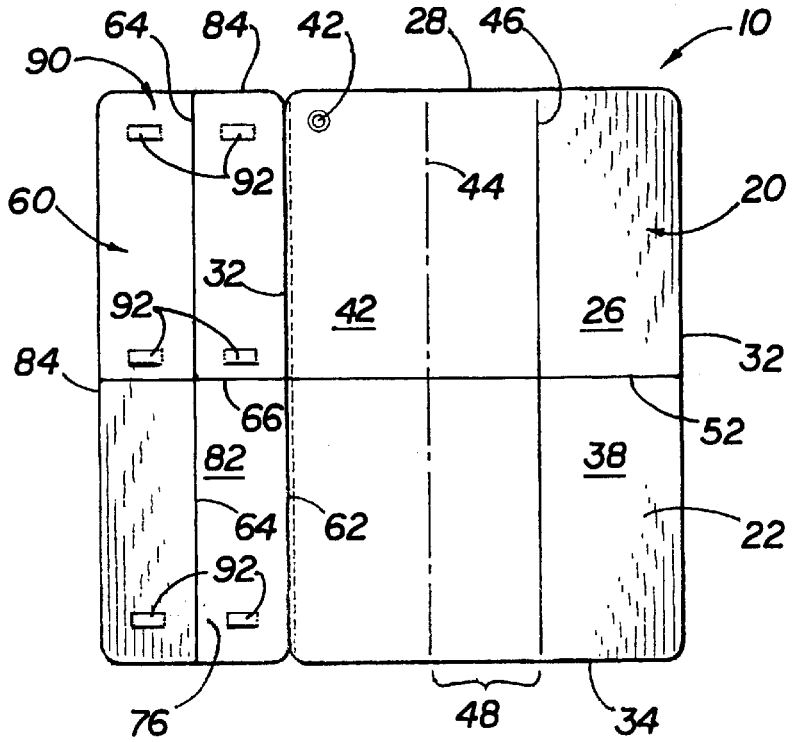
FIG. 2 is a back view of an entryway protection device according to a preferred embodiment of the present invention.

As illustrated in FIGS. 1 and 2, main section 20 comprises a sheet or cover 22 having a front face 24, a back face 26 and top, side and bottom edge walls 28, 32 and 34. Main section 20 preferably is rectangular in shape, but can easily incorporate a variety of other shapes and sizes. The front face 24 and back face 26 of main section 20 are separated from one another by edge walls 28, 32 and 34. Cover 22 can be designed as an integral cover 22, or faces 24, 26 and walls 28, 32, 34 can be formed of separate sections, and woven, or joined by other known means, together to form cover 22. The thickness of edge walls 28, 32, 34 define the thickness of main section 20, or the amount of protection between an exposed surface and the moving equipment, materials or furniture.

Preferably, main section 20 comprises a cushioning material 36 completely enclosed by the cover 22. Alternatively, main section 20 can be formed much the same way as a fancy pillowcase with an outer cover surrounding a pocket into which a pillow is slipped and placed. The back face 26 of main section 20 comprises back face first flap 38 and back face second flap 42. Back face first flap 38 terminates at cut line 44 shown in dotted line extending under back face second flap 42, and back face second flap 42 terminates at cut line 46. Back face first flap 38 folds under back face second flap 42 and into the pocket of main section 20. Thus, entrance inside main section 20 and into the pocket, between front face 24 and back face 26, can be had under cut line 46. Overlying zone 48 is formed by back face second flap 42 overlying back face first flap 38.

Figure 3:
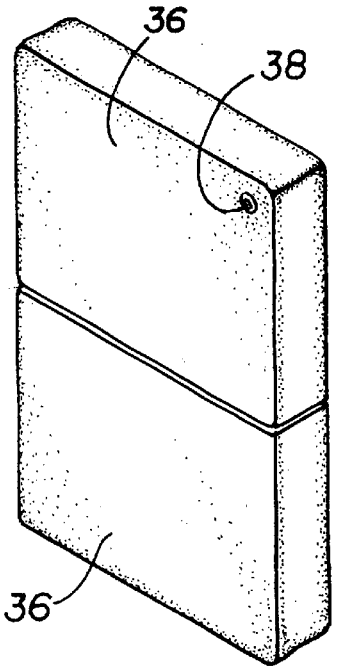
(PRIOR ART) FIG 3
FIG. 3 shows a conventional cushioning material used in conjunction with the present invention.
Figure 4:
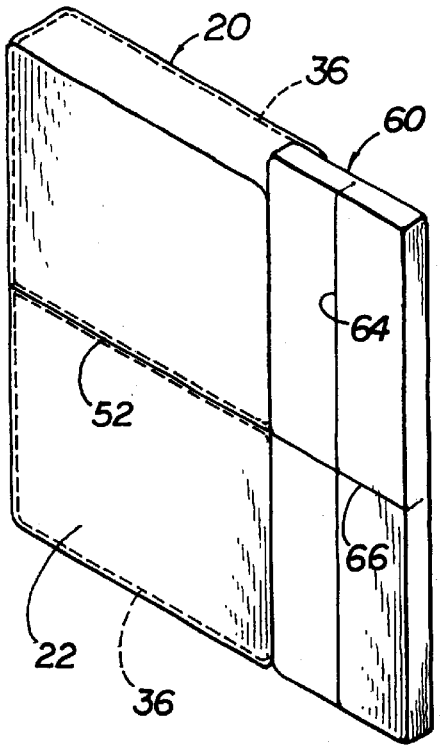
FIG. 4 shows the entryway protection device of FIG. 2 with the cushioning material of FIG. 3.

As shown in FIG. 3, generally the cushioning material 36 is rectangular, and is preferably 6'8" in height by 2'8" in length by three inches thick. In the "pillowcase" embodiment, the cushioning material 36 is inserted into the pocket of main section 20. In FIG. 4, the cushioning material 36 is surrounded by the cover 22 of main section 20.

In preferred form, sheet or cover 22 comprises a puncture-resistant material so as to protect the cushioning material 36 from puncture, such as vinyl and the like which can provide main section 20 with an outer surface that can at least resist bumps and scraps from most construction materials. The cover 22 preferably provides puncture resistance against those objects and forces that typically contact building surfaces during moving or custom construction. The cover 22 also should be of suitable construction to provide a lightweight protection device 10.

Should protector 10 encounter a puncture or scratch that passes through the cover 22 and damages the integrity of the cushioning material 36, one need only replace a relatively inexpensive pad of cushioning material 36 to reuse the protector 10. Otherwise, the protector 10 can take repeated bumps and even punctures without repair as long as the pad of cushioning material 36 can maintain a barrier of protection for the surface.

Figure 5:
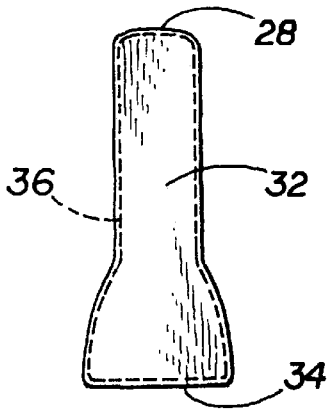
FIG. 5 is a side view of the main section of the present protector according to another preferred embodiment.

Main section 20 preferably has a bottom thickness of bottom edge wall 34, sufficient to allow main section 20 to remain upright against a wall, which thickness has been found to be at least approximately three inches. To increase the stability of main section 20, the thickness of bottom edge wall 34 can be increased by providing a cover 22 wider at the bottom edge wall 34 than top edge wall 28. In this embodiment as illustrated in FIG. 5, cover 22 is designed accommodate a non-uniform thickness pad of cushioning material 36 being thinner at the top and thicker at the bottom. This provides main section 20 with a larger base, increasing the ability of main section 20 to remain upright without external securing.

Referring again to FIGS. 1 and 2, main section 20 is further provided with fold line 52 about which the main section can be horizontally folded. The cushioning material 36 is preferably scored at fold line 52 to provide ease of folding. Horizontal fold line 52 enables the height of main section 20 to be folded in half for easy storage and carrying.

Figure 6:
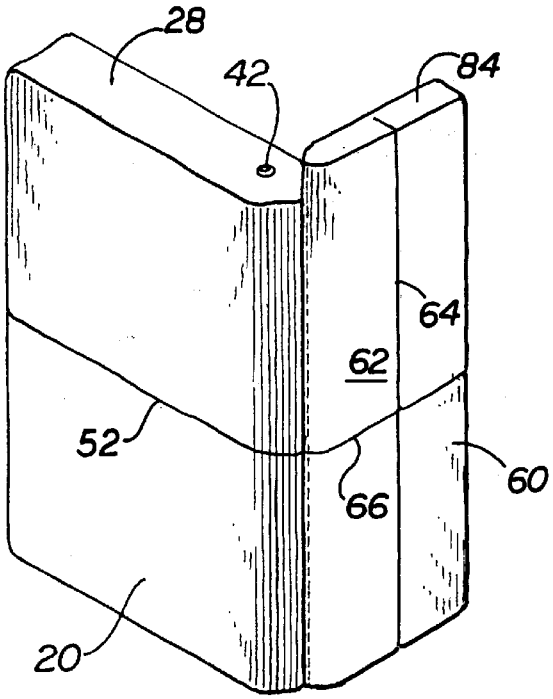
FIG. 6 shows a perspective view of a preferred embodiment of the present invention.
Figure 7:
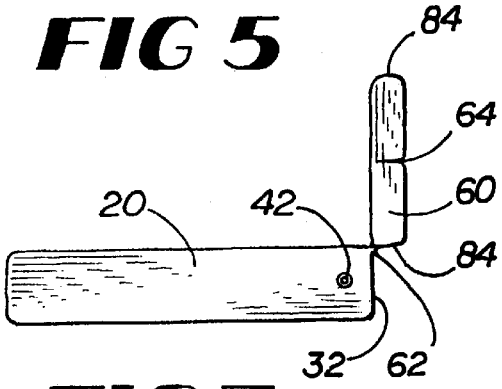
FIG. 7 is a top view of a preferred embodiment of the present invention.

The entryway protector 10 preferably further comprises minor flap 60. Minor flap 60 attaches to main section 20 along a substantial length of main section 20 by a line of stitching 62. The line of stitching 62 enables the minor flap 60 to rotate independent of main section 20 as shown in FIGS. 6 and 7. As will be obvious, minor flap 60 alternatively can be secured to main section 20 by a number of well known methods, other than by a line of stitching 62.

Minor flap 60 further comprises vertical fold line 64. Vertical fold line 64 preferably bisects minor flap 60 into two minor flap components 72, 74 as illustrated in FIG. 1. In application, the two minor flap components 72, 74 can be folded over on each other if the environment necessitates such a minor flap 60 width half that of the minor flap components 72, 74 unfolded. Preferably, each minor flap component 72, 74 is approximately seven inches wide. Such minor flap flexibility is required as the jamb panels in proximity to the elevator door typically are either seven inches wide or 14 inches wide.

Minor flap 60 can also incorporate horizontal fold lines 66. Horizontal fold line 66 is preferably a continuation of horizontal fold line 52 of main section 20, such that minor flap 60 can also fold horizontally.

Minor flap 60 may have different dimensions than main section 20. FIGS. 1 and 2 illustrate minor flap 60 and main section 20 having the same height. Alternatively, FIGS. 4, 5 and 7 show the minor flap 60 being both taller than main section 20, and less thick. In some environments, minor flap 60 will need to protect to the top of the jamb panel of an elevator, wherein the jamb panel is usually two inches or more taller than the door. Preferably, the approximate dimensions of the minor flap 60 are 6'10" in height by 1'2" in length by one inch thick. Thus, in preferred form, minor flap 60 extends taller than main section 20 by approximately 2 inches.

The minor flap 60 generally comprises a cover material similar to, if not the same as, the cover 22 of main section 20. The covering material 76 of minor flap 60 has a front side 78 and back side 82, both sides 78, 82 continuously connected by edge walls 84. In a preferred embodiment, minor flap 60 comprises a stuffing of cushioning material 36 surrounded by a closed vinyl cover 76.

The line of stitching 62 may comprise a side edge of both main section 20 and flap panel 60, as shown in FIG. 6. Alternatively, main section 20 and minor flap 60 can be formed by their respective edge walls 32, 84 as shown in FIG. 7. As such, line of stitching 62 can connect two adjacent corners of main section 20 and flap panel 60.

Figure 8:
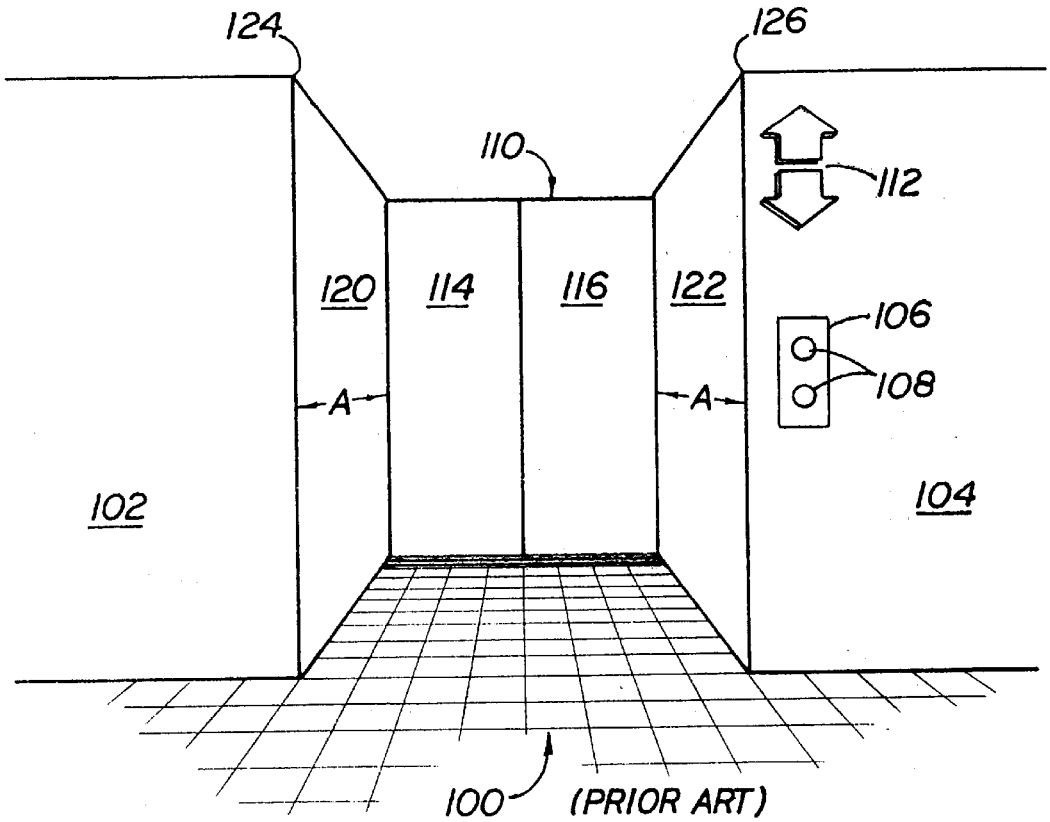
FIG. 8 illustrates a conventional hallway having an inset elevator.

In use, entryway protector 10 protects exposed surfaces from deformation from dents and scratches produced by a collision with construction material, furniture and moving equipment. FIG. 8 depicts a conventional hallway 100 having an elevator 110 set back from the side walls 102, 104 of hallway 100. As shown, side wall 104 typically includes button panel 106, buttons 108 and elevator indicator 112.

Elevator 110 includes elevator doors 114, 116, set back from hallway walls 102, 104. Hallway 100 typically further comprises elevator jamb panels 120, 122 that span the set back depth of elevator doors 114, 116. These jamb panels 120, 122 are specifically prone to damage from moving objects in and out of elevator 110. Jamb panels 120, 122 have a width A being the distance that elevator 110 is set back from hallway walls 102, 104. As discussed previously, width A is typically either seven or 14 inches. Generally, hallway walls 102, 104 are perpendicular to jamb panels 120, 122, respectively, thus producing ninety degree corners 124, 126, respectively. The present invention 10 works equally as well with acute or obtuse corners 124, 126.

Figure 9:
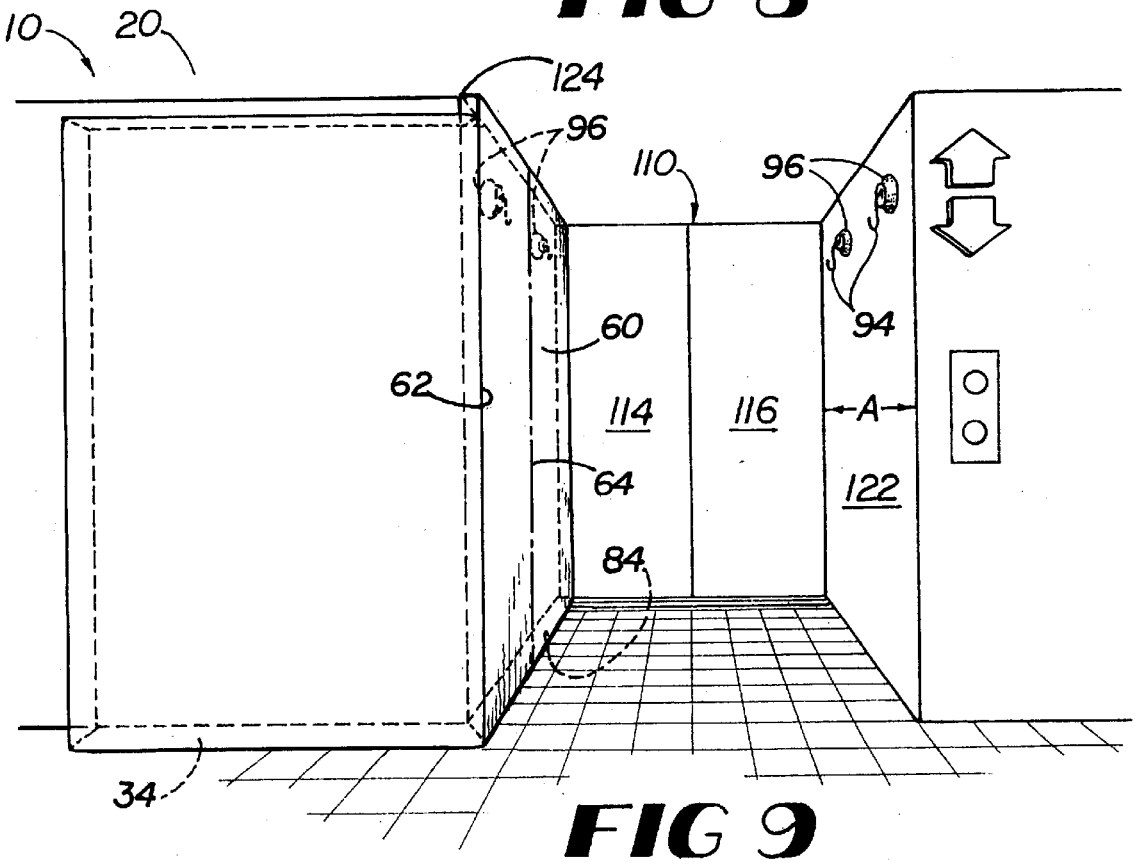
FIG. 9 shows a preferred embodiment of the present invention protecting wall surfaces in proximity to the elevator and hallway of FIG. 8.

In one application of protector 10 shown in FIG. 9, protector 10 is placed as a protective barrier over side wall 102 and jamb panel 120, to protect these surfaces from construction materials and the like passing through elevator doors 114, 116. Main section 20 is left free standing against a length of hallway wall 102. The thickness of main section 20 enables main section 20 to remain upright without attaching main section 20 to side wall 102. Thus, hallway wall 102 remains free of distracting holes or extensions necessary to provide a hanging assembly for the conventional mat or pad.

Protector 10 wraps around corner 124 at line of stitching 62 so that minor flap 60 rests over jamb panel 120. Minor flap 60 preferably extends a substantial width A of jamb panel 120. A top view of the protector 10 shown in FIG. 9 is illustrated in FIG. 7.

The minor flap 60 may not have a sufficient thickness or rigidity to remain upright without being releasably secured to jamb panel 120. Thus, in one embodiment of the present invention 10, minor flap 60 is provided with securing component 90 comprising straps 92 on its back face 82, as shown in FIG. 2. Straps 92 can be sown onto the back face 82, or can be formed by cutting entirely through minor flap 60 such that an orifice through the minor flap is provided. (Such a cut-though arrangement enables the minor flap to be hung in uses when the minor flap 60 is folded in half about fold line 64). The strap portions 92 can be formed in the top portion of minor flap 60, or in a vertical row of straps 92. Straps 92 are formed to receive a hanging attachment such as extending hooks 94 of suction cups 96. As shown in FIG. 9, suction cups 96 with extending hooks 94 preferably engage straps 61 of minor flap 60 to releasably secure minor flap 60 in an upright position against jamb panel 122. Suction cups 96 have been found to work well on jamb panels 120, 122 which have smooth, flat, non-porous surfaces, of, for example, aluminum, marble, steel and formica. Use of suction cups 62 does not require any setup construction in jamb panels 120, 122. It has been found that conventional plastic or rubber suction cups 96 provide enough suction to hold the minor flap 60 upright.

Preferably, each minor flap component 72, 74 has a line of strap portions 92, which lines would align if minor flap 60 is folded about fold line 64. In such a configuration, two rows of suction cups 96 could be used to secure an unfolded minor flap 60, or one row of suction cups 96 could secure a folded minor flap 60 (as the orifice of each strap 92 would align so hooks 94 could extend through and support both components 72, 74).

In lieu of strap portions 92, grommets may be located through minor flap components 72, 74 through which hooks 94 can extend.

Alternatively, suction cups 96 may be formed integral with minor flap 60 as shown in FIG. 1. The suction cups 96 can either be placed on the front or back sides 78, 82, in any location so as to hold minor panel 60 against jamb panel 120.

Thus described, protector 10 protects portions of hallway wall 102 and jamb panel 120 in proximity to elevator 110. It will be understood that protector 10 can similarly protect hallway wall 104 and jamb panel 122. Protector 10 is easily hung by just one individual, without in any way damaging hallway wall 102 or jamb panel 120. Should an object either entering or exiting elevator 110 puncture sections 20 and/or 60 such that the protector 10 can no longer ensure protection, the protector 10 is removed from contact with hallway wall 102 and jamb panel 120 so that the sections can be fitted with a pad new cushioning material 36.

Figure 10:
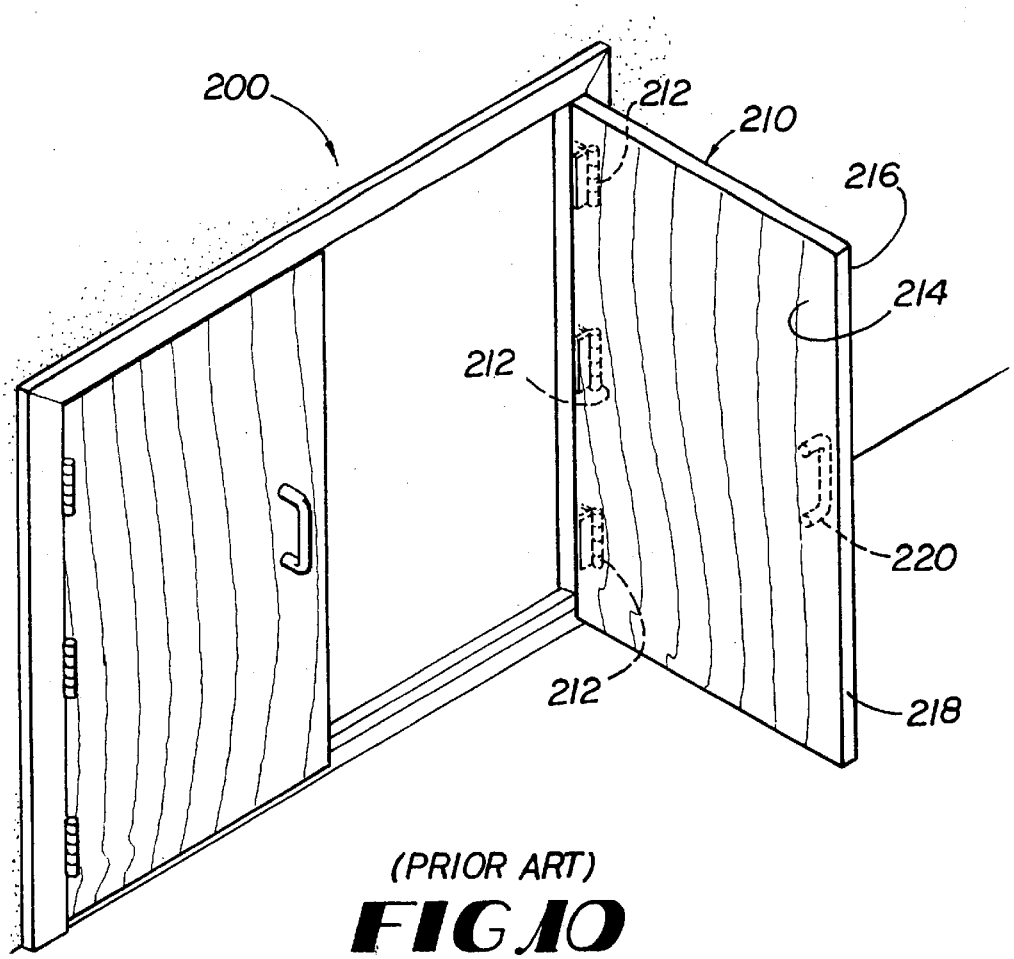
(PRIOR ART) FIG 10
FIG. 10 illustrates a conventional doorway with a door propped opened.

In another use of entryway protector 10, the protector 10 is fitted around a door of a doorway through which the furniture, moving or construction materials pass. FIG. 10 illustrates a common doorway 200 having a door 210 with a handle 220 rotational fixed to a doorjamb by hinges 212. Doorway 200 can be a doorway to an apartment complex, office building, or any other type of building. Doorway 200 with door 210 typically creates an obstruction, or narrowing, of a hallway or other passageway in which the doorway is set. For this reason, the open door is often bumped into by objects moving through the passageway.

As shown in FIG. 10, door 210 has an inner surface 214 and an outer surface 216 opposed to surface 214. Inner surface 214 is the exposed surface of door 210 because when door 210 is opened, surface 214 is vulnerable to bumps and scratches from objects traveling through the doorway 200. Similarly, door width 218 is vulnerable to collision from objects moving through doorway 200. It will be understood that should door 210 open the other way through doorway 200, the exposed surface of door 210 would be surface 216.

Figure 11:
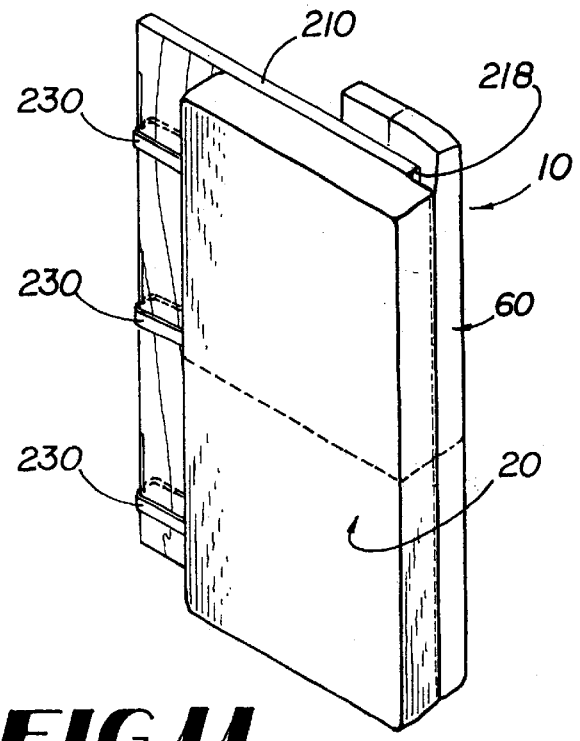
FIG. 11 is a perspective view of a preferred embodiment of the present invention hugging the open door of FIG. 10.

As shown in FIG. 11, door 210 can be wrapped behind entryway protector 10; thus, providing a barrier between moving objects or construction materials and a substantial portion of exposed surface 214 and width 218 of door 210. As shown, minor flap 60 is placed in proximity to width 218 and wrapped around a portion of outer surface 216 of door 210. The main section 20 of protector 10 lies against a substantial portion of exposed surface 214 of door 210, and again can remain upright because of its bottom width.

In order to ensure protector 10 will remain in contact with the surfaces of door 210 even upon collision with furniture, moving or construction materials, securing component 60 can comprise belts 230. Preferably, belts 230 adjustably secure main section 20 to minor flap 60 around the width of the door opposed to width 218. Hinges 212 space the door 210 a distance away from the door jamb of doorway 200. This distance allows belts 230 to pass through and around the width of door 210.

Figure 12:
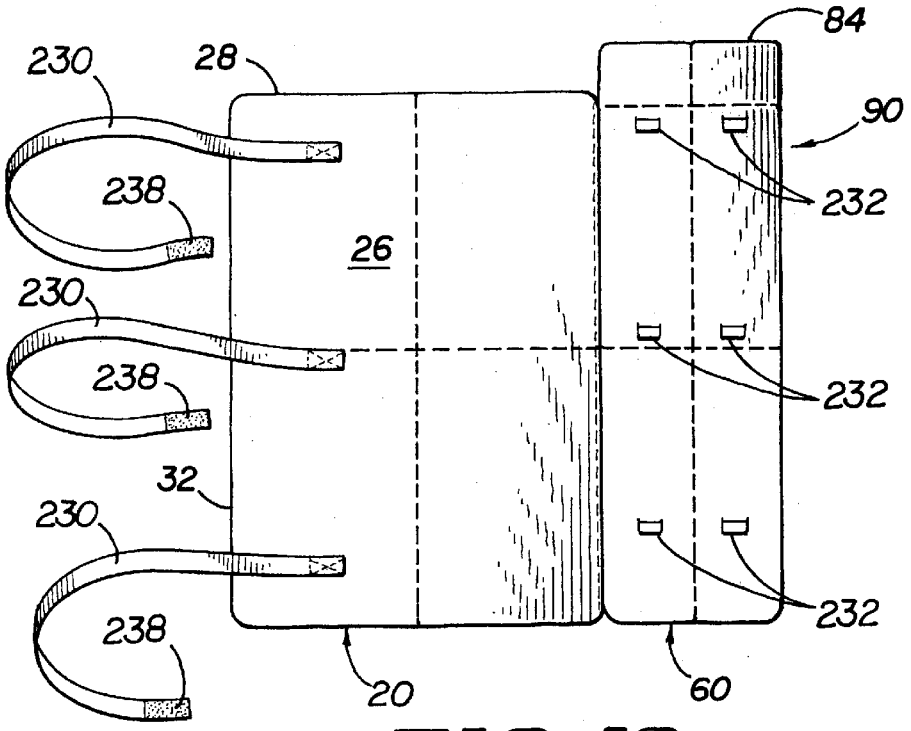
FIG. 12 is one embodiment of the present invention having straps and loops in order to secure the present invention to the door of FIG. 10.

In this embodiment, securing component 60 further comprises buckles and the like to lock the adjustment of belts 230 so that protector 10 stays in place around door 210. For example, as shown in FIG. 12 belts 230 can extend from back face 26 of main section 20, or can alternatively extend from edge wall 32. Further, minor flap 60 is provided with a securing mechanism 232. The three ends 238 of belts 230 slip in and through locking mechanism 232 and secure protector 10 around door 210.

It will be understood that other suitable embodiments of securing component 60 can be constructed. Belts 230 may extend from any suitable location on main section 20 and secure to minor flap 60 in any suitable location and by a variety of securing components. For example, securing components 60 may comprise snaps located on the free end 238 of belts 230 or a strap buckle assembly. In another embodiment, hook and loop fasteners can be used to secure belts 230. Further, protector 10 can be secured to door 210 by similar means as described previously in relation to the elevator 110. In this embodiment, no belts 230 would be required.

Figure 13:
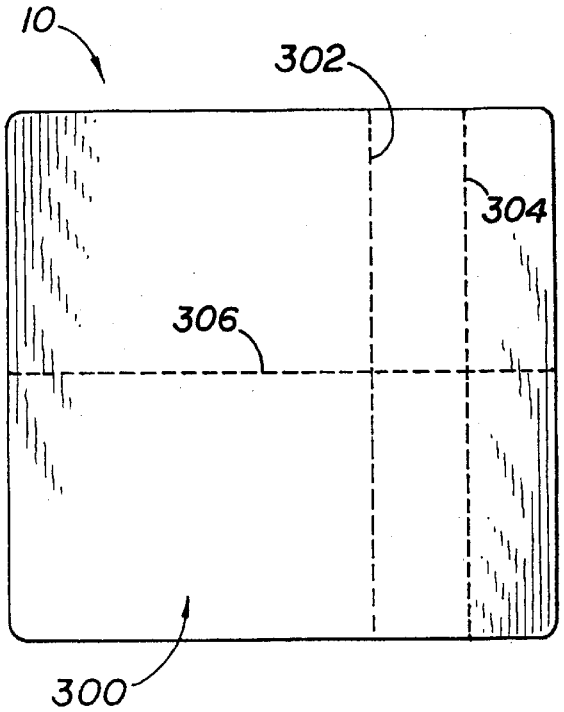
FIG. 13 is a front view of another preferred embodiment of the present invention.
Figure 14:
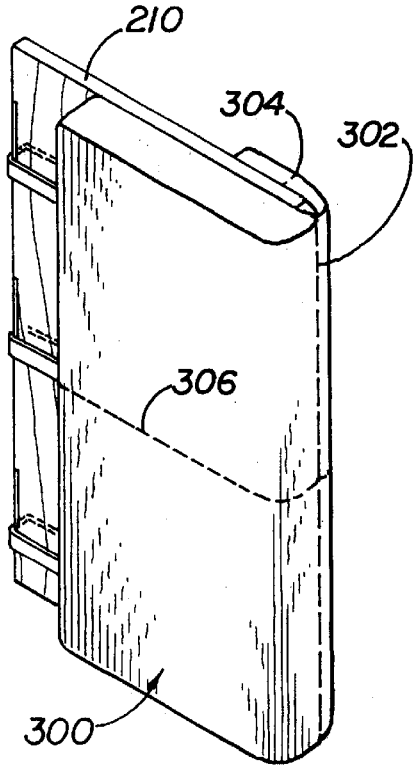
FIG. 14 is a perspective view of the entryway protector of FIG. 13 hugging an open door.

Other embodiments of protector 10 can be constructed. As shown in FIG. 13, entryway protector 10 can comprise but a single unit 300 having vertical lines of folding 302, 304, and a horizontal line of folding 306—all providing fold lines about which unit 300 can be folded to form configurations as discussed above. For example, FIG. 14 shows unit 300 wrapping around door 210 generally at line of folding 302. These two single unit embodiments could also include that the portion of unit 300 to the right of fold line 302 as shown in FIGS. 13 and 14 extend taller than the rest of unit 300.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A portable device for protecting surfaces of an entryway from moving objects therethrough, the entryway having a first and a second surface, the device comprising:

(a) a main section of a main protection material having a main horizontal fold line, the main section capable of protecting the first surface, said main section having a top and bottom with the bottom being thicker than the top such that the device can stand on its own while leaning against the first and second surfaces;

(b) a minor flap of a minor protection material rotatably connected to the main section, them minor flap having a minor horizontal fold line, the minor flap further having a minor vertical fold line defining a first and a second minor flap component, the minor flap having a total width of the first and second minor flap components and capable of protecting a distance of the total width of the second surface, the minor flap further having a minor width being the width of the minor flap when the first minor flap component is folded atop the second minor flap component via the minor vertical fold line such that the minor flap also is capable of protecting a distance of the minor width of the second surface; and (c) a noninvasive securing system capable of securing the device to the surfaces to be protected;

the main section and minor flap capable of being foldable about the main and minor horizontal fold lines, respectively, providing portability to the device.

2. The device of claim 1, the height of the first and second minor flap components being greater than the height of the main section.

3. A portable device for protecting surfaces of an entryway from moving objects therethrough, the entryway having a first and a second surfaces, the device comprising:

(a) a main section of a protection material enclosed in a main protective sleeve, the main section having a horizontal fold line, the main protective sleeve including a front face, a back face first flap and a back face second flap, the back face second flap capable of folding under the back face flap, the protection material capable of insertion into the main protective sleeve through an access between the back face first flap and the back face second flap, the main section capable of protecting the first surface, said main section having a top and bottom with the bottom being thicker than the top;

(b) a minor flap of the protection material enclosed in a minor protective sleeve, the minor flap rotatably connected to the main section, the horizontal fold line extending across the minor flap, the minor flap further having a minor vertical fold line defining a first and a second minor flap component, the minor flap having a total width of the first and second minor flap components and capable of protecting a distance of the total width of the second surface, the minor flap further having a minor width being the width of the minor flap when the first minor flap component is folded atop the second minor flap component via the minor vertical fold line such that the minor flap also is capable of protecting a distance of the minor width of the second surface; and (c) A noninvasive securing system capable of securing the device to the surfaces to be protected;

the main section and minor flap capable of being foldable about the horizontal fold line providing portability to the device.

4. The device of claim 3, the height of the first and second minor flap components being greater than the height of the main section.

5. The device of claim 3, the securing system comprising grommets in both the first and second minor flap components, wherein upon folding the first and second minor flap components about the minor vertical fold line and upon one another, a grommet of the first minor flap component is aligned with a grommet of the second minor flap component.

6. The device of claim 3, the securing system comprising suction cups.

* * * * *